US006213016B1

(12) United States Patent
Tsunashima

(10) Patent No.: US 6,213,016 B1
(45) Date of Patent: Apr. 10, 2001

(54) CYLINDER THROWING-OFF/THROWING-ON CONTROLLER FOR A MULTICOLOR LITHOGRAPHIC ROTARY PRESS

(75) Inventor: Makoto Tsunashima, Kawasaki (JP)

(73) Assignee: Tokyo Kikai Seisakusho Ltd., Tokyo (JP)

( * ) Notice: Subject to any disclaimer, the term of this patent is extended or adjusted under 35 U.S.C. 154(b) by 0 days.

(21) Appl. No.: 09/553,467

(22) Filed: Apr. 19, 2000

(30) Foreign Application Priority Data

Sep. 14, 1999 (JP) ..... 11-260334

(51) Int. Cl.[7] ..... B41F 7/02

(52) U.S. Cl. ..... 101/218; 101/139; 101/143; 101/180; 101/182; 101/247

(58) Field of Search ..... 101/178, 179, 101/180, 181, 182, 184, 185, 218, 219, 220, 247, 138, 139, 140, 143, 144, 145

(56) References Cited

U.S. PATENT DOCUMENTS

| | | | | |
|---|---|---|---|---|
| Re. 34,483 | * | 12/1993 | Bowman et al. | 101/138 |
| 3,167,025 | * | 1/1965 | Nothmann | 101/144 |
| 3,964,387 | * | 6/1976 | Werner | 101/247 |
| 6,019,039 | * | 2/2000 | Knauer et al. | 101/218 |

FOREIGN PATENT DOCUMENTS 49-86106 8/1974 (JP) .

7-381 1/1995 (JP) .

* cited by examiner

*Primary Examiner*—Ren Yan
(74) *Attorney, Agent, or Firm*—Armstrong, Westerman, Hattori, McLeland & Naughton, LLP

(57) ABSTRACT

A cylinder throwing-off/throwing-on controller for a multicolor lithographic rotary press in which paper splicing is performed. The cylinder throwing-off/throwing-in controller comprises a pulse generator for outputting a pulse signal every time the paper web travels a predetermined distance; a cylinder throwing-off timing adjustment unit including a counter and a setting device for setting a target count value in advance, the counter starting in response to the paper splicing signal, counting the pulse signal from the pulse generator, and outputting a cylinder throwing-off signal when the counted value reaches the target count value; a cylinder throwing-on timing adjustment unit provided for each of the printing units, the cylinder throwing-on timing adjustment unit starting in response to the cylinder throwing-off signal and outputting a cylinder throwing-on signal after elapse of a preset period of time; and a cylinder throwing-off/throwing-on mechanism for simultaneously moving the blanket cylinders of the plurality of printing units from the printing position to the non-printing position in response to the cylinder throwing-off signal and for sequentially moving the blanket cylinders of the plurality of printing units from the non-printing position to the printing position in response to the cylinder throwing-on signal, from the furthest-upstream printing unit toward the furthest-downstream printing unit.

2 Claims, 3 Drawing Sheets

CYLINDER THROWING-OFF/THROWING-ON CONTROLLER FOR A MULTICOLOR LITHOGRAPHIC ROTARY PRESS

BACKGROUND OF THE INVENTION

1. Field of the Invention

The present invention relates to a cylinder throwing-off/throwing-on controller for effecting movement of blanket cylinders of printing units from a printing position to a non-printing position, as well as movement of the blanket cylinders from the non-printing position to the printing position, and more particularly to a cylinder throwing-off/throwing-on controller for a multicolor lithographic rotary press having a plurality of printing units for effecting multicolor printing.

2. Description of the Related Art

In a multicolor lithographic rotary press, a new paper web is spliced to a paper web currently being pulled out of a paper feed unit and is fed to printing units to thereby follow the currently fed paper web. Such a multicolor lithographic rotary press is provided with a cylinder throwing-off/throwing-on controller which throws off the cylinders of each printing unit in order to enable a spliced portion, at which the new paper web is superposed on the currently fed paper web, to smoothly pass through the printing units. A conventional cylinder throwing-off/throwing-on controller is disclosed in, for example, Japanese Patent Publication (kokoku) No. 7-381 entitled "Cylinder Throwing-off Method for a Printing Press."In the cylinder throwing-off/throwing-on controller disclosed in Japanese Patent Publication No. 7-381, a pulse signal is generated every time a paper web moves a predetermined distance with operation of the rotary press, and a printing speed is calculated on the basis of a measured time interval between the pulse signals. A moving time of the paper web in a section of a transport path between a paper splicing position at which a paper splicing signal is generated and a position at which the paper web comes into contact with the blanket cylinder of a first printing unit is calculated on the basis of the printing speed and the length of the section along the transport path. Further, a moving time of the paper web in a section of the transport path between adjacent printing units is calculated on the basis of the printing speed and the length of the corresponding section along the transport path.

The moving times of the paper web calculated in the above-described manner are corrected for a delay in outputting a detection signal upon detection of the paper splicing position, as well as a delay in operation of a cylinder throwing-off apparatus of each printing unit, in order to calculate a time delay before outputting a cylinder throwing-off signal to each of the first through n-th printing units. In accordance with the thus-calculated delay times, cylinder throwing-off signals are sequentially output to the cylinder throwing-off apparatuses of the respective printing units.

The period of time during which the cylinder is maintained at the non-printing position is calculated on the basis of the above-described printing speed and a moving distance of a paper web between a point in time when the cylinder throwing-off operation is started and a point in time when the cylinder throwing-off operation is ended, wherein the printing speed and the moving distance are stored as preset values. The cylinder throwing-off operation at each printing unit is ended in accordance with the thus-calculated values.

The system comprises memory, an input interface, an output interface, and a CPU. The memory stores therein a calculation equation and various calculation elements such as the distance along the paper web transport path between the position at which the paper splicing signal is generated and the position at which the paper web comes into contact with the blanket cylinder of the first printing unit; the distance along the transport path between adjacent printing units; the delay in outputting a detection signal upon detection of the paper splicing position; the delay in operation of the cylinder throwing-off apparatus of each printing unit; and a distance over which the paper web passes the corresponding printing unit between a point in time when the cylinder throwing-off operation is started and a point in time when the cylinder throwing-off operation is ended. The input interface receives the pulse signals and the detection signal generated upon detection of the paper splicing position. The CPU outputs the cylinder throwing-off signal via the output interface. The CPU receives various signals via the input interface, performs calculation on the basis of the calculation equation and the calculation elements, and in accordance with the calculated values successively outputs several cylinder throwing-off signals via the output interface. (Hereinafter, the above-described prior art technique will be referred to as the "first conventional technique.")

Further, the patent publication—which discloses the first conventional technique—discloses another cylinder throwing-off/throwing-on controller. In this cylinder throwing-off/throwing-on controller, a counter is provided for each printing unit, and a pulse signal is generated every time a paper web moves a predetermined distance. In the first printing unit, upon receipt of a detection signal generated upon detection of a paper splicing position at which paper splicing is performed, the counter corresponding to the first printing unit is caused to count the pulse signal. When the counted value has reached a preset value, a cylinder throwing-off signal is output to the cylinder throwing-off mechanism of the first printing unit. At the same time, the cylinder throwing-off signal is output to the counter corresponding to the next or second printing unit as a signal which instructs start of pulse signal counting. When the counter corresponding to the second printing unit has counted a preset number of pulse signals, a cylinder throwing-off signal is output to the cylinder throwing-off mechanism of the second printing unit. This operation is repeated for the downstream printing units. In an exemplary case in which the cylinder throwing-off/throwing-on controller is used in a four-color rotary press, four counters are provided in order to sequentially throw off the cylinders of the printing units for respective colors. (Hereinafter, the above-described prior art technique will be referred to as the "second conventional technique.")

The above-exemplified conventional techniques involve the following problems.

In the first conventional technique, calculation by use of various calculation elements is performed in the CPU on the basis of the calculation equation; the result of the calculation is stored in the memory; and a cylinder throwing-off signal is output to each of the printing units via the output interface. Such accurate control requires a complicated control system, and the complexity results in a high frequency of occurrence of failures and high cost of the apparatus itself.

Further, a paper web easily stretches due to changes in printing conditions such as printing speed and paper web tension. Therefore, even when a moving time corresponding to a moving distance of the paper web is calculated accurately and the cylinder throwing-off operation is performed on the basis of the thus calculated moving time, the timing of cylinder throwing-off deviates from the timing at which the spliced portion of the paper web passes by the corresponding blanket cylinder, due to an error in the moving distance stemming from the stretch of the paper web, resulting in a possibility that printing cannot be performed stably.

In the second conventional technique, since the counter for counting reference signal pulses is provided for each printing unit, counters equal in number to the printing units are required, so that the number of parts increases, resulting in increased cost. Further, maintenance is cumbersome.

The printing units of a multicolor lithographic rotary press are disposed such that the distance between adjacent printing units is reduced to a greatest possible extent, in order to perform multicolor printing in a more stable manner. In addition, recently, the printing operation has been performed at extremely high speed, and therefore, the time which each portion of a paper web requires to pass through a section between adjacent printing units is very short. Moreover, a period of time longer than an operation delay of the cylinder throwing-off apparatus is required for completing the cylinder throwing-off operation after issuance of the corresponding cylinder throwing-off signal.

As described above, in the second conventional technique, a counter is provided for each printing unit; simultaneously with completion of the counting operation of the counter of the first printing unit, a cylinder throwing-off signal is output to the counter corresponding to the second printing unit; and such signal input and output is repeated from the second printing unit to the final printing unit in order to perform cylinder throwing-off operation. Therefore, there is a possibility that the spliced portion of paper web passes through the contact portion at which the paper web comes into contact with the blanket cylinder before completion of the cylinder throwing-off operation started in response to the output signal of the corresponding counter. Accordingly, multicolor printing cannot be performed in a stable manner.

SUMMARY OF THE INVENTION

The present invention is accomplished in order to solve the problems involved in the above-described conventional techniques, and an object of the present invention is to provide a cylinder throwing-off/throwing-on controller for a multicolor lithographic rotary press, which has a reduced number of components, can be manufactured at considerably low cost, and can be maintained easily, and which can perform in a reliable manner a cylinder throwing-off operation before a spliced portion of a paper web passes by a blanket cylinder and a cylinder throwing-on operation after the spliced portion of the paper web has passed by the blanket cylinder.

Another object of the present invention is to provide a cylinder throwing-off/throwing-on controller for a multicolor lithographic rotary press, which can be used in a multicolor lithographic rotary press in which respective printing units are disposed to be close to one another in order to improve printing quality, which can perform the cylinder throwing-off operation at a proper timing even when paper web stretches due to a change in printing conditions, or when a preset printing speed for splicing is changed, and which enables stable printing while eliminating possibility of the paper web being broken.

A cylinder throwing-off/throwing-on controller according to the present invention is provided in a multicolor lithographic rotary press which comprises a plurality of printing units each having paired blanket cylinders movable between a printing position and a non-printing position and adapted to successively perform printing on a supplied paper web in different colors; and a paper feed unit adapted to supply a paper web of a paper roll and to splice a leading end of a new paper roll to the paper web of the currently used paper roll in response to a paper splicing signal which is output from splicing signal output means when the currently used paper roll runs out due to printing operation of the printing units.

The cylinder throwing-off/throwing-on controller according to a first aspect comprises: a pulse generator connected to a member rotating due to operation of the rotary press and adapted to output a pulse signal every time the paper web travels a predetermined distance during the operation of the rotary press; cylinder throwing-off timing adjustment means including count means and setting means for setting a target count value in advance, the count means starting in response to the paper splicing signal output from the splicing signal output means, counting the pulse signal from the pulse generator, and outputting a cylinder throwing-off signal when the counted value reaches the target count value; cylinder throwing-on timing adjustment means provided for each of the printing units, the cylinder throwing-on timing adjustment means starting in response to the cylinder throwing-off signal and outputting a cylinder throwing-on signal after elapse of a preset period of time; and cylinder throwing-off/throwing-on means for simultaneously moving the blanket cylinders of the plurality of printing units from the printing position to the non-printing position in response to the cylinder throwing-off signal and for sequentially moving the blanket cylinders of the plurality of printing units from the non-printing position to the printing position in response to the cylinder throwing-on signal, from the furthest-upstream printing unit toward the furthest-downstream printing unit.

The cylinder throwing-off/throwing-on controller according to a second aspect comprises: cylinder throwing-on timing adjustment means provided for each of the printing units, the cylinder throwing-on timing adjustment means starting in response to the paper splicing signal and outputting a cylinder throwing-on signal after elapse of a preset period of time; and cylinder throwing-off/throwing-on means for simultaneously moving the blanket cylinders of the plurality of printing units from the printing position to the non-printing position in response to the paper splicing signal and for sequentially moving the blanket cylinders of the plurality of printing units from the non-printing position to the printing position in response to the cylinder throwing-on signal, from the furthest-upstream printing unit toward the furthest-downstream printing unit.

In the cylinder throwing-off/throwing-on controller according to the first aspect, when a leading end of a new paper roll is spliced to the paper web of the currently used paper roll in response to a paper splicing signal from the splicing signal output means, the paper splicing signal is input to the count means as well. Upon receipt of the paper splicing signal, the count means starts counting of the pulse signal output from the pulse generator. When the counted value reaches the target count value set by use of the setting means, the count means outputs a cylinder throwing-off signal to the cylinder throwing-off/throwing-on means of each of the plurality of printing units.

In the cylinder throwing-off/throwing-on controller according to the second aspect, the paper splicing signal is supplied, as a cylinder throwing-off signal, directly to the cylinder throwing-off/throwing-on means of each of the plurality of printing units.

Upon receipt of the cylinder throwing-off signal, the cylinder throwing-off/throwing-on means operates in order to simultaneously move the blanket cylinders of the plurality of printing units from the printing position to the non-printing position, so that a clearance which enables smooth passage of the spliced portion is formed between the blankets. That is, cylinder throwing-off is effected.

Upon receipt of the cylinder throwing-off signal, each cylinder throwing-on timing adjustment means starts clocking operation and outputs a cylinder throwing-on signal to the cylinder throwing-off/throwing-on means upon elapse of a preset period of time which is set for the cylinder throwing-on timing adjustment means in advance.

Upon receipt of the corresponding cylinder throwing-on signal, each cylinder throwing-off/throwing-on means moves the blanket cylinders of the corresponding printing unit from the non-printing position to the printing position, so that the blanket cylinders of the plurality of printing units are sequentially moved from the non-printing position to the printing position, from the furthest-upstream printing unit toward the furthest-downstream printing unit. Thus, the clearance between the blanket cylinders of each printing unit is eliminated, or cylinder throwing-on is effected.

In the cylinder throwing-off/throwing-on controller according to the first aspect, the count means starts in response to a brush/cutter actuation signal (paper splicing signal) generated upon performance of paper splicing at the paper feed unit and outputs a cylinder throwing-off signal when the counted value reaches a target count value set by use of the setting means; and in accordance with the cylinder throwing-off signal, the plurality of lithographic printing units are caused to perform cylinder throwing-off operation simultaneously. Therefore, only a single cylinder throwing-off timing adjustment means, such as count means and setting means, is required.

In the cylinder throwing-off/throwing-on controller according to the second aspect, since the brush/cutter actuation signal (paper splicing signal) is used as is to cause the plurality of lithographic printing units to perform cylinder throwing-off operation simultaneously, the cylinder throwing-off timing adjustment means, such as count means and setting means, is unnecessary.

In either case, the cylinder throwing-off/throwing-on controller for a multicolor lithographic rotary press according to the present invention comprises a reduced number of components, can be manufactured at considerably low cost, and can be maintained easily, as compared with conventional apparatuses.

Further, in the cylinder throwing-off/throwing-on controller according to the first aspect, when the timing at which the cylinder throwing-off operation is performed after performance of paper splicing, or when a target count value is set to the count means by use of the setting means, the paper web is assumed to travel at a moving speed slightly faster than the actual moving speed during printing operation; and in the cylinder throwing-off/throwing-on controller according to the second aspect, the cylinder throwing-off operation is performed in response to the paper splicing signal. Therefore, cylinder throwing-off operation is performed at each printing unit at proper timing without excessive delay, even when the operation speed changes slightly.

Further, in the cylinder throwing-off/throwing-on controllers according to the first and second aspects, upon setting of the timing of the cylinder throwing-on operation, or the operation timing of cylinder throwing-on timing adjustment means, the paper web is assumed to travel at a moving speed slightly faster than the actual moving speed. Therefore, the cylinder throwing-on operation is not performed too early at any of the printing units, even when the operation speed changes slightly. Accordingly, it becomes possible to prevent variation in tension of the paper web and resultant breakage of the paper web, which variation in tension would otherwise occur when the spliced portion of the spliced paper web passes through the contact area between the blanket cylinders located at the printing position.

Moreover, in the cylinder throwing-off/throwing-on controller according to the first aspect, the cylinder throwing-off operation is simultaneously performed at the plurality of printing units at substantially the same time the cylinder throwing-off signal is output; and in the cylinder throwing-off/throwing-on controller according to the second aspect, the cylinder throwing-off operation is simultaneously performed at the plurality of printing units at substantially the same time the paper splicing signal is output. Therefore, the plurality of printing units can be disposed to be close to one another, so that the quality of multicolor printing in the multicolor lithographic rotary press can be improved.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Cylinder throwing-off/throwing-on controllers for a multicolor lithographic rotary press according to embodiments of the present invention will next be described in detail with reference to the drawings.

Figure 1:
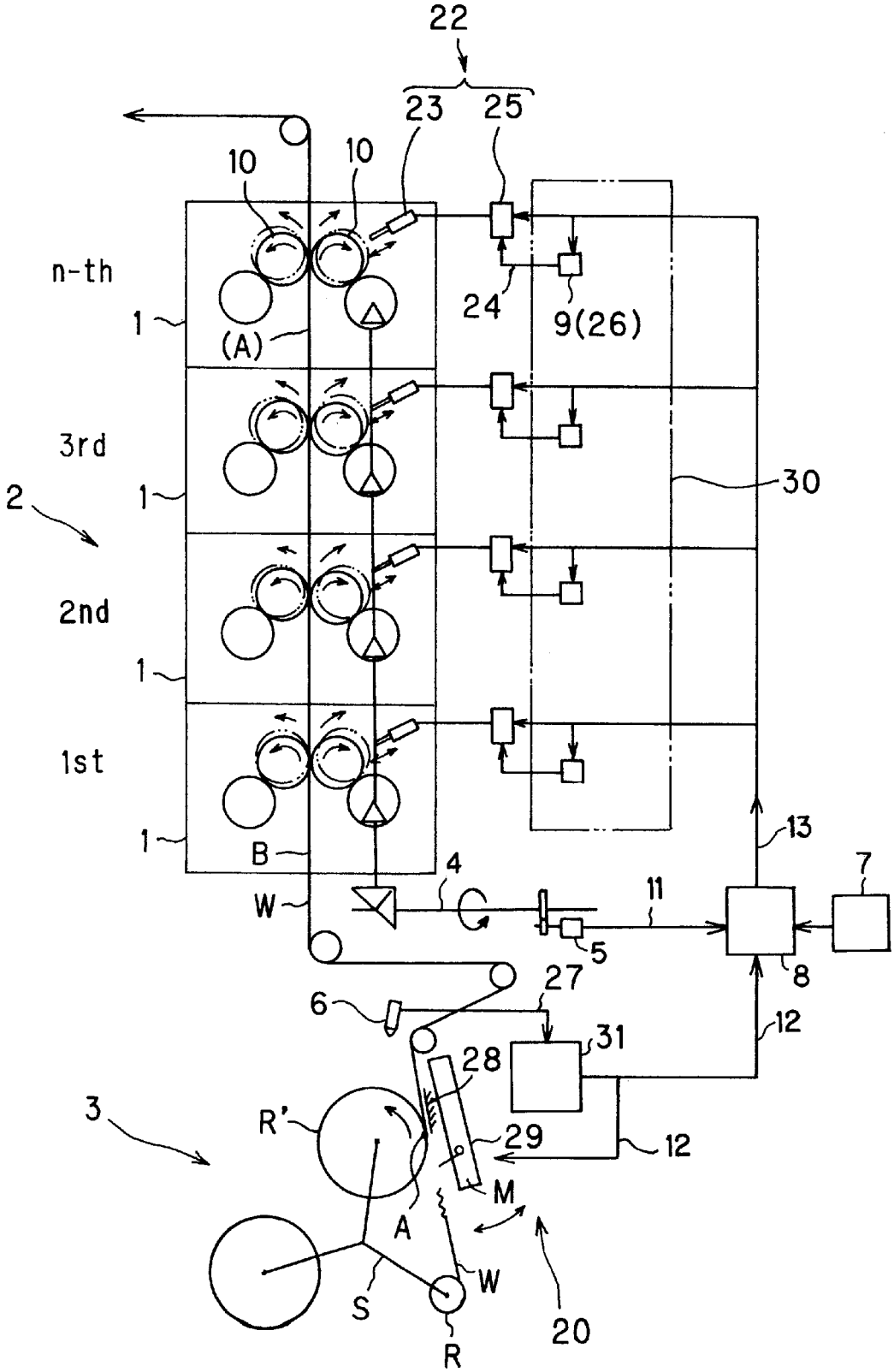
FIG. 1 is a side view of a multicolor lithographic rotary press having a cylinder throwing-off/throwing-on controller according to a first embodiment of the present invention.
Figure 2:
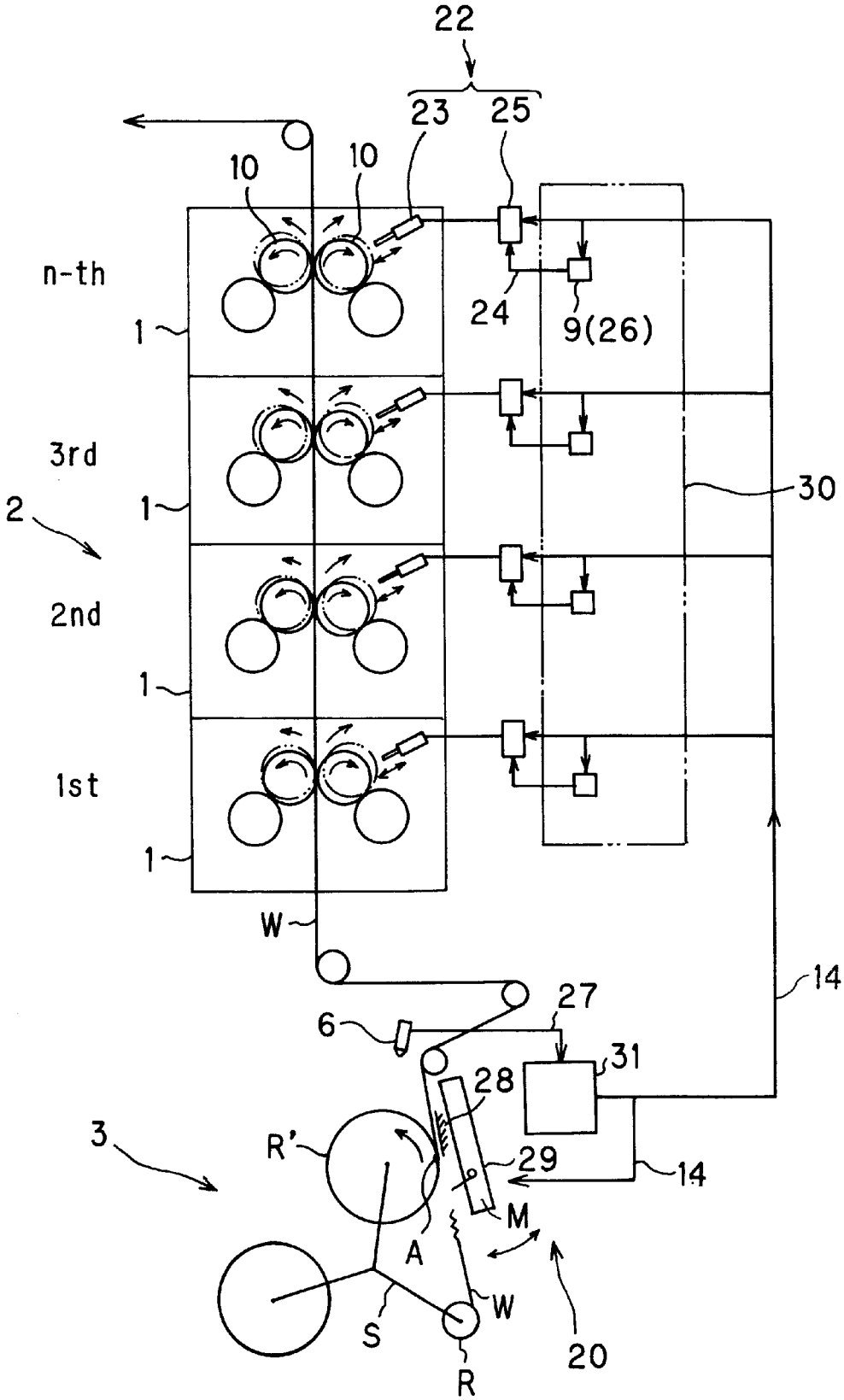
FIG. 2 is a side view of a multicolor lithographic rotary press having a cylinder throwing-off/throwing-on controller according to a second embodiment of the present invention.

FIGS. 1 and 2 each show a rotary press which comprises a multicolor lithographic printing press 2, a paper feed unit 3, and a cylinder throwing-off/throwing-on controller according to the present invention.

The multicolor lithographic printing press 2 includes a first printing unit 1, a second printing unit 1, a third printing unit 1, . . . and an n-th printing unit 1, which are stacked in this sequence to form a tower. In each printing unit 1, paired blanket cylinders 10 are disposed in an opposed manner.

The paper feed unit 3 disposed under the multicolor lithographic printing press 2 includes a spider S to which are attached paper rolls R and R' and a paper splicer.

The paper splicer is disposed in the vicinity of the paper roll R, from which a paper web is currently fed. The paper splicer comprises signal output means 20 and a splicing arm M having a brush 28 and a cutter 29. The signal output means 20 includes a sensor 6 and a brush/cutter circuit 31.

When the residual amount of the paper roll R from which the paper web W is fed toward a downstream side reaches a predetermined limit, a paper splicing operation is performed in order to feed a paper web W from a new paper roll R' in a continuous manner. During such a paper splicing operation, the sensor 6 of the signal output means 20 detects the position of the leading end of the paper web W on the surface of the new paper roll R' and outputs a position detection signal 27 to the brush/cutter circuit 31. In response to the position detection signal 27, the brush/cutter circuit 31 outputs a brush/cutter actuation signal (splicing signal) 12 (14) to a drive section (not shown) for the splicing arm M, the brush 28, and the cutter 29 such that the splicing arm M operates at a proper timing.

The paper web W pulled out of the paper roll R of the paper feed unit 3 is caused to travel, while successively passing through a contact area between the blanket cylinders 10 of each printing unit 1. When the residual amount of the currently used paper roll R reaches a predetermined limit, a paper splicing operation is performed. More specifically, through the operation of the paper splicer, the leading portion of the paper web W of the new paper roll R' on the spider S is superposed on and adhesively bonded to the web paper W of the paper roll R, and the web paper W of the paper roll R is cut on the upstream side of the bonded portion. Subsequently, the spider S is rotated to allow the new paper roll R' to continuously feed the paper web W to the multicolor lithographic printing press 2.

The thickness of the spliced portion at which the old and new paper webs W are bonded together during the above-described splicing operation is greater than two times the thickness of the paper web W, due to interposition of adhesive therebetween.

When the spliced portion—which has a thickness greater than two times the thickness of the paper web W—passes through the contact area between the blanket cylinders 10 of the printing unit 1, in which printing pressure is applied between the blanket cylinders 10, an abrupt increase in the thickness resists travel of the paper web W, so that the tension of the paper web W on the downstream side of the blanket cylinders 10 increases abruptly, resulting in possible breakage of the paper web W.

When such web breakage occurs, the portion of the paper web W located on the upstream side with respect to the broken portion loses tension force which had been received from the downstream side, and the broken end becomes a free end. Consequently, the portion of the paper web W between the broken point and the blanket cylinders 10 on the upstream side falls down on the blanket cylinders 10 and winds therearound, damaging the blanket surface of the blanket cylinders 10. In the multicolor lithographic printing press 2 having the printing unit 1 at a plurality of stages, the number of times the spliced portion of the paper web W passes through the contact area between the blanket cylinders 10 becomes equal to the number of printing units 1, so that the possibility of the paper web W breaking increases.

In order to prevent such web breakage, the rotary press is provided with a cylinder throwing-off/throwing-on controller as described below.

A cylinder throwing-off/throwing-on controller according to a first embodiment of the present invention will be described with reference to FIGS. 1 and 3.

As shown in FIG. 1, the cylinder throwing-off/throwing-on controller comprises the above-described splicing signal output means 20 of the paper splicer; a pulse generator 5 for outputting a pulse signal 11 every time the paper web W travels a predetermined distance; a cylinder throwing-off timing adjustment means 21 including count means 8 which outputs a cylinder throwing-off signal 13, and setting means 7 for setting to the count means 8 a target count value; cylinder throwing-off/throwing-on means 22 provided for each of the printing units 1; and cylinder throwing-on timing adjustment means 26 provided for each of the printing units 1.

The pulse generator 5 is connected via a gear transmission to a rotating drive member of the rotary press; e.g., a main spindle 4 of the rotary press. In the case of a rotary press which does not have a main spindle 4, such as a shaftless rotary press, the pulse generator 5 is appropriately connected to a driven member of each printing unit driven by a corresponding motor; e.g., the shaft of a blanket cylinder or the shaft of a plate cylinder (not shown).

Each pulse signal 11 output from the pulse generator 5 connected to the main spindle 4 of the rotary press represents movement of the paper web W over a predetermined distance. The pulse generator 5 is connected to the count means 8 of the cylinder throwing-off timing adjustment means 21 so as to supply the pulse signal 11 to the count means 8.

In the case of the shaftless rotary press, all the driven members are rotated in a synchronized manner. Therefore, a pulse generator 5 connected to an arbitrary driven member; e.g., a pulse generator 5 belonging to the printing unit 1 located furthest upstream with respect to the travel direction of the paper web W, is connected to the count means 8 of the cylinder throwing-off timing adjustment means 21 so as to supply the pulse signal 11 to the count means 8.

Further, the brush/cutter circuit 31 is connected to the count means 8 of the cylinder throwing-off timing adjustment means 21, so that the brush/cutter actuation signal (paper splicing signal) 12 output from the brush/cutter circuit 31 is input to the count means 8. Moreover, the setting means 7 is connected to the count means 8 in order to input and set a target count value.

A cylinder throwing-off operation is started when a spliced portion of the paper web W moves from a splicing position A—at which the splicing arm M performs splicing in response to the brush/cutter actuation signal (paper splicing signal) 12 output from the brush/cutter circuit 31—to a proper position B on the upstream side of the first printing unit 1. For such an operation, the count means 8 starts counting of the pulse signal 11 from the pulse generator 5 upon receipt of the brush/cutter actuation signal (paper splicing signal) 12, and outputs a count completion signal as a cylinder throwing-off signal 13 when the counted value reaches the target count value set by use of the setting means 7.

The target count value set by use of the setting means 7 is determined in consideration of the physical characteristics of the paper web W, the path distance from the splicing position A to the position B, an approximate moving speed of the paper web W during printing operation, and a delay in operation of a cylinder throwing-off mechanism 23, which will be described later, such that when the count means 8 outputs the cylinder throwing-off signal 13, the spliced portion of the paper web W is located at the position B on the upstream side of the first printing unit 1.

At this time, the paper web W is assumed to travel at a moving speed slightly faster than the actual moving speed. That is, the target count value is determined to output the cylinder throwing-off signal 13 at a timing such that the cylinder throwing-off operation is completed during a period in which the spliced portion of the paper web W moves from the position B to the position at which the opposed blanket cylinders 10 of the first printing unit 1 come into contact.

Each cylinder throwing-off/throwing-on means 22 throws off the blanket cylinders 10 of the each printing unit 1 such that a clearance greater than the thickness of the spliced portion of the paper web W is formed between the blanket cylinders 10, and subsequently throws in the blanket cylinders 10 in order to eliminate the clearance. The cylinder throwing-off/throwing-on means 22 is connected to the count means 8 in order to receive the cylinder throwing-off signal 13 from the count means 8 and is connected to a timer 9, which will be described later, in order to receive a cylinder throwing-on signal 24 from the timer 9. The cylinder throwing-off/throwing-on means 22 comprises a solenoid valve 25 for effecting changeover of pressurized-fluid passages in accordance with the signals from the count means 8 and the timer 9; and a cylinder throwing-off mechanism 23 which is driven by a fluid cylinder connected to the pressurized-fluid passages which are changed over by the solenoid value 25.

Each cylinder throwing-on timing adjustment means 26 comprises the timer 9 which is provided for each printing unit 1 and is connected to the count means 8 in order to receive the cylinder throwing-off signal 13. The timer 9 starts upon receipt of the cylinder throwing-off signal 13. When a preset time has been counted, the timer 9 outputs the cylinder throwing-on signal 24 to the solenoid value 25 of the corresponding cylinder throwing-off/throwing-on means 22.

The timers 9 are disposed together on an operation panel 30 provided on a cover of, for example, the first printing unit 1.

The operation of the cylinder throwing-off/throwing-on controller according to the first embodiment will be described with reference to FIGS. 1 and 3.

When the residual amount of the paper roll R from which the paper web W is fed toward the downstream side reaches a predetermined limit, a paper splicing operation is started in order to continuously supply the paper web W of the new paper roll R'. That is, the spider S rotates, so that the surface of the new paper roll R' approaches the paper web W pulled out of the paper roll R, and the new paper roll R' itself is rotated by unillustrated drive means.

When the sensor 6 detects the position of the leading end of the paper web W on the surface of the new paper roll R', the sensor 6 outputs the position detection signal 27 to the brush/cutter circuit 31.

In response to the position detection signal 27, the brush/cutter circuit 31 outputs a brush/cutter actuation signal (paper splicing signal) 12 to the drive section (not shown) for the splicing arm M, the brush 28, and the cutter 29 such that the splicing arm M and the brush 28 operate at a timing such that the brush 28 is applied to the leading end of the paper web W of the new paper roll R' having reached the splicing position A, and the cutter 29 operates subsequent to the operation of the brush 28. At the same time, the brush/cutter actuation signal (paper splicing signal) 12 is fed to the count means 8.

The drive section operates in accordance with the input brush/cutter actuation signal (paper splicing signal) 12, so that the brush 28 presses and bonds the paper web W of the currently used paper roll R onto the leading end of the paper web W of the new paper roll R', to which leading end adhesive has been applied, and the cutter 29 cuts the paper web W of the paper roll R at a position upstream of the bonded portion.

Figure 3:
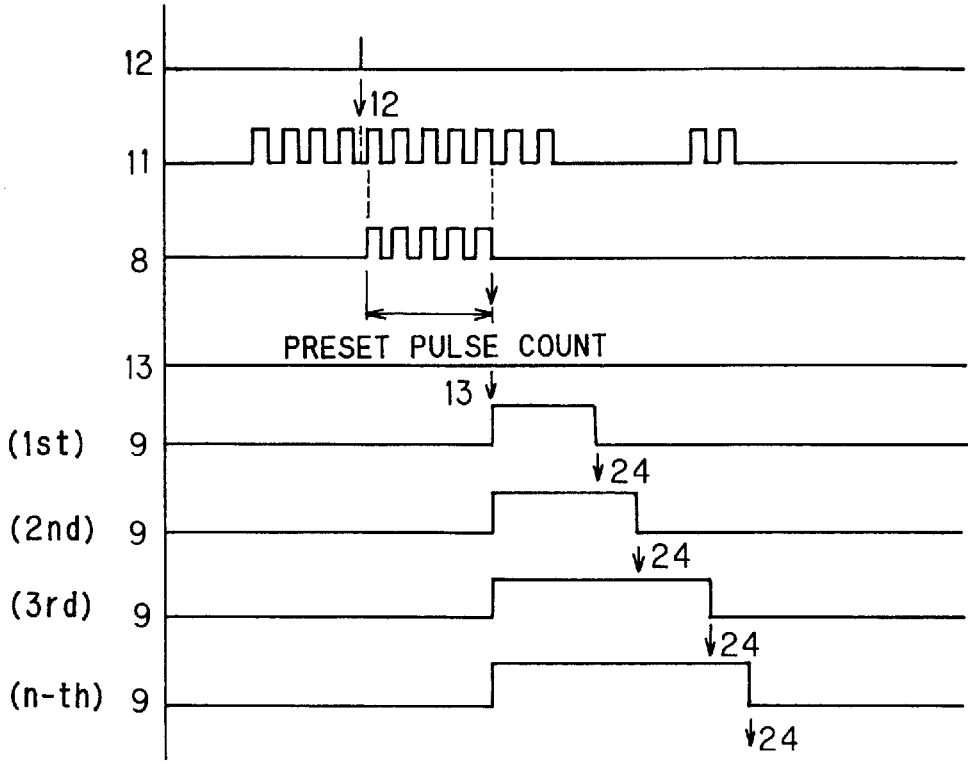
FIG. 3 is a timing chart showing the phases of cylinder throwing-off/throwing-on signals output from the cylinder throwing-off/throwing-on controller according to the first embodiment of the present invention.

Upon receipt of the brush/cutter actuation signal (paper splicing signal) 12 from the brush/cutter circuit 31, the count means 8 starts counting of the pulse signal 11 output from the pulse generator 5 (see the second row in FIG. 3).

When the counted value reaches a target count value set in the count means 8 by use of the setting means 7, the cylinder throwing-off signal 13 is output from the count means 8 (see the third and fourth rows in FIG. 3) and is supplied to the solenoid valve 25 of the cylinder throwing-off/throwing-on means 22 of each of the first through n-th printing units 1. Simultaneously, the cylinder throwing-off signal 13 is supplied, as a start signal, to the timer 9 of each cylinder throwing-on timing adjustment means 26.

Upon receipt of the cylinder throwing-off signal 13, the solenoid valve 25 changes over the pressurized-fluid passages such that the fluid cylinder operates in one direction in order to drive the cylinder throwing-off mechanism 23. Consequently, the cylinder throwing-off mechanism 23 moves the opposed blanket cylinders 10 from the printing position to the non-printing position to thereby form between the blanket cylinders 10 a clearance which enables smooth passage of the spliced portion. That is, cylinder throwing-off is effected.

When the cylinder throwing-off signal 13 is supplied to the timer 9 of the cylinder throwing-on timing adjustment means 26 of each printing unit 1, the timer 9 starts clocking operation. The time preset in each timer 9 is slightly longer than a time which the spliced portion of the paper web W requires to pass through the contact area between the blanket cylinders 10 of the corresponding printing unit 1. When the timer 9 has counted the preset time, the timer 9 outputs the cylinder throwing-on signal 24 to the solenoid valve 25 of the corresponding cylinder throwing-off/throwing-on means 22 (see the fifth, sixth, seventh, and eighth rows of FIG. 3).

Upon receipt of the cylinder throwing-on signal 24, the solenoid valve 25 changes over the pressurized-fluid passages such that the fluid cylinder operates in the opposite direction in order to drive the cylinder throwing-off mechanism 23 to thereby move the blanket cylinders 10 from the non-printing position to the printing position, so that the clearance between the blanket cylinders 10 is eliminated. That is, cylinder throwing-on is effected.

When a fluid cylinder is used for drive of the cylinder throwing-off mechanism 23, the position B at which the cylinder throwing-off operation is started is determined in consideration of a delay in operation of the fluid cylinder. That is, the position B is determined to be located on the upstream side of the position at which the paired blanket cylinders 10 come into contact, such that the cylinder throwing-off operation is completed during the period in which the spliced portion of the paper web W moves from the position B to the position at which the paired blanket cylinders 10 come into contact. The position B varies depending on the preset value set by use of the setting means 7 of the cylinder throwing-off timing adjustment means 21.

Since the cylinder throwing-off signal 13 is output on the basis of the preset value in order to simultaneously throw off the blanket cylinders of the respective printing units 1, the printing units 1 can be disposed to be close to one another.

The pairs of the blanket cylinders 10 of the respective printing units 1, which have been thrown off in the above-described manner, are successively thrown on at proper timings, from the furthest-upstream printing unit toward the furthest-downstream printing unit.

The timings are set by the timers 9 of the respective cylinder throwing-on timing adjustment means 26. That is, the time preset in each timer 9 is sufficiently long so that the spliced portion of the paper web W having passed through the position B can reach and completely pass through the contact area between the paired blanket cylinders 10 of the corresponding printing unit 1, and the cylinder throwing-on operation of each printing unit 1 is performed in accordance with the preset time.

The time preset in each timer 9 is determined in consideration of the physical property of the paper web W, the path distance from the position B to the position at which the paired blanket cylinders 10 of the corresponding printing unit 1 come into contact, and an approximate moving speed of the paper web W during printing operation. At this time, the paper web W is assumed to travel at a moving speed slightly slower than the actual moving speed.

Figure 4:
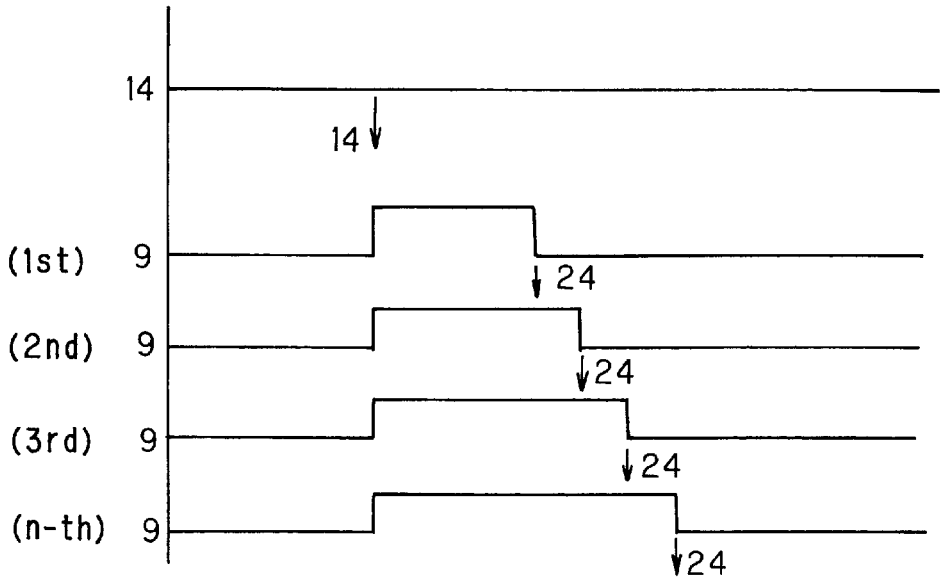
FIG. 4 is a timing chart showing the phases of cylinder throwing-off/throwing-on signals output from the cylinder throwing-off/throwing-on controller according to the second embodiment of the present invention.

A cylinder throwing-off/throwing-on controller according to a second embodiment of the present invention will be described with reference to FIGS. 2 and 4.

The cylinder throwing-off/throwing-on controller according to the second embodiment is used when the distance between the paper feed unit 3 and the multicolor lithographic printing press 2 is short.

As shown in FIG. 2, the cylinder throwing-off/throwing-on controller comprises splicing signal output means 20; cylinder throwing-off/throwing-on means 22 provided for each of the printing units 1; and cylinder throwing-on timing adjustment means 26 provided for each of the printing units 1. The splicing signal output means 20 includes a brush/cutter circuit 31 for generating a brush/cutter actuation signal 14, which severs as a paper splicing signal for instructing performance of a paper splicing operation in the paper feed unit 3 and on the basis of which the cylinder throwing-off/throwing-on controller is operated.

Each cylinder throwing-off/throwing-on means 22 throws off the blanket cylinders 10 of each printing unit 1 such that a clearance greater than the thickness of the spliced portion of the paper web W is formed between the blanket cylinders 10, and subsequently throws on the blanket cylinders 10 in order to eliminate the clearance. The cylinder throwing-off/throwing-on means 22 is connected to the splicing signal output means 20 in order to receive the brush/cutter actuation signal (paper splicing signal) 14 output from the splicing signal output means 20 and is connected to a timer 9, which will be described later, in order to receive a cylinder throwing-on signal 24 from the timer 9. The cylinder throwing-off/throwing-on means 22 comprises a solenoid valve 25 for effecting changeover of pressurized-fluid passages in accordance with the above-described signals; and a cylinder throwing-off mechanism 23 which is driven by a fluid cylinder connected to the pressurized-fluid passages which are changed over by the solenoid value 25.

Each cylinder throwing-on timing adjustment means 26 comprises the timer 9 which is provided for each printing unit 1 and is connected to the splicing signal output means 20 in order to receive the brush/cutter actuation signal 14. The timer 9 starts upon receipt of the brush/cutter actuation signal 14. When a preset time has been counted, the timer 9 outputs the cylinder throwing-on signal 24 to the solenoid value 25 of the corresponding cylinder throwing-off/throwing-on means 22.

The timers 9 are disposed together on an operation panel 30 provided on a cover of, for example, the first printing unit 1.

The operation of the cylinder throwing-off/throwing-on controller according to the second embodiment will be described with reference to FIGS. 2 and 4.

As in the first embodiment, the brush/cutter circuit 31 outputs a brush/cutter actuation signal (paper splicing signal) 14 to the drive section (no shown) for the splicing arm M, the brush 28, and the cutter 29 such that the splicing arm M and the brush 28 operate at a timing such that the brush 28 is applied to the leading end of the paper web W of the new paper roll R' having reached the splicing position A, and the cutter 29 operates subsequent to the operation of the brush 28 (see the description of the operation of the first embodiment).

At the same time, the brush/cutter actuation signal 14 output from the brush/cutter circuit 31 is fed to the solenoid valve 25 of the cylinder throwing-off/throwing-on means 22 of each of the first through n-th printing units 1. Further, the brush/cutter actuation signal 14 is supplied, as a start signal, to the timer 9 of each cylinder throwing-on timing adjustment means 26.

The drive section operates in accordance with the input brush/cutter actuation signal (paper splicing signal) 14, so that the brush 28 presses and bonds the paper web W of the currently used paper roll R onto the leading end of the paper web W of the new paper roll R', to which leading end adhesive has been applied, and the cutter 29 cuts the paper web W of the paper roll R at a position upstream of the bonded portion.

Upon receipt of the brush/cutter actuation signal (paper splicing signal) 14, the solenoid valve 25 changes over the pressurized-fluid passages such that the fluid cylinder operates in one direction in order to drive the cylinder throwing-off mechanism 23. Consequently, the cylinder throwing-off mechanism 23 moves the opposed blanket cylinders 10 from the printing position to the non-printing position to thereby form between the blanket cylinders 10 a clearance which enables smooth passage of the spliced portion. That is, cylinder throwing-off is effected.

Since the cylinder throwing-off/throwing-on means 22 of all the printing units 1 are operated simultaneously in response to the brush/cutter actuation signal 14 supplied from the paper feed unit 3, to thereby perform the cylinder throwing-off operation, the cylinder throwing-off operation can be performed reliably even when the fluid cylinder and the cylinder throwing-off mechanism 23 operate with slight delay.

When the brush/cutter actuation signal 14 is supplied to the timer 9 of the cylinder throwing-on timing adjustment means 26 of each printing unit 1, the timer 9 starts clocking operation.

The time preset in each timer 9 is slightly longer than a time period between the point in time when the timer 9 receives the brush/cutter actuation signal 14 and the point in time when the spliced portion of the paper web W passes through the contact area between the blanket cylinders 10 of the corresponding printing unit 1. When the timer 9 had counted the preset time, the timer 9 outputs the cylinder throwing-on signal 24 to the solenoid valve 25 of the corresponding cylinder throwing-off/throwing-on means 22 (see FIG. 4).

Upon receipt of the cylinder throwing-on signal 24, the solenoid valve 25 changes over the pressurized-fluid passages such that the fluid cylinder operates in the opposite direction in order to drive the cylinder throwing-off mechanism 23 to thereby move the blanket cylinders 10 from the non-printing position to the printing position, so that the clearance between the blanket cylinders 10 is eliminated. That is, cylinder throwing-on is effected.

As described above, the pairs of the blanket cylinders 10 of the respective printing units 1, which have been thrown off in the above-described manner, are successively thrown on at proper timings. That is, the time preset in each timer 9 is sufficiently long so that the spliced portion of the paper web W having left from the position A—at which the brush/cutter actuation signal 14 is output—an reach and completely pass through the contact area between the paired blanket cylinders 10 of the corresponding printing unit 1, and the cylinder throwing-on operation of the printing unit 1 is performed in accordance with the preset time.

The time preset in each timer 9 is determined in consideration of the physical property of the paper web W, the path distance from the position A to the position at which the paired blanket cylinders 10 of the corresponding printing unit 1 come into contact and an approximate moving speed of the paper web W during printing operation. At this time, the paper web W is assumed to travel at a moving speed slightly slower than the actual moving speed.

Obviously, numerous modifications and variations of the present invention are possible in light of the above teachings. It is therefore to be understood that within the scope of the appended claims, the present invention may be practiced otherwise than as specifically described herein.

What is claimed is:

1. A cylinder throwing-off/throwing-on controller for a multicolor lithographic rotary press which comprises a plurality of printing units each having paired blanket cylinders movable between a printing position and a non-printing position and adapted to successively perform printing on a supplied paper web in different colors; and a paper feed unit adapted to supply a paper web of a paper roll and to splice a leading end of a new paper roll to the paper web of the currently used paper roll in response to a paper splicing signal which is output from splicing signal output means when the currently used paper roll runs out due to printing operation of the printing units, the cylinder throwing-off/throwing-on controller comprising:

a pulse generator connected to a member rotating due to operation of the rotary press and adapted to output a pulse signal every time the paper web travels a predetermined distance during the operation of the rotary press;

cylinder throwing-off timing adjustment means including count means and setting means for setting a target count value in advance, the count means starting in response to the paper splicing signal from the splicing signal output means, counting the pulse signal from the pulse generator, and outputting a cylinder throwing-off signal when the counted value reaches the target count value;

cylinder throwing-on timing adjustment means provided for each of the printing units, the cylinder throwing-on timing adjustment means starting in response to the cylinder throwing-off signal and outputting a cylinder throwing-on signal after elapse of a preset period of time; and cylinder throwing-off/throwing-on means for simultaneously moving the blanket cylinders of the plurality of printing units from the printing position to the non-printing position in response to the cylinder throwing-off signal and for sequentially moving the blanket cylinders of the plurality of printing units from the non-printing position to the printing position in response to the cylinder throwing-on signal, from the furthest-upstream printing unit toward the furthest-downstream printing unit.

2. A cylinder throwing-off/throwing-on controller for a multicolor lithographic rotary press which comprises a plurality of printing units each having paired blanket cylinders movable between a printing position and a non-printing position and adapted to successively perform printing on a supplied paper web in different colors; and a paper feed unit adapted to supply a paper web of a paper roll and to splice a leading end of a new paper roll to the paper web of the currently used paper roll in response to a paper splicing signal which is output from splicing signal output means when the currently used paper roll runs out due to printing operation of the printing units, the cylinder throwing-off/throwing-on controller comprising:

cylinder throwing-on timing adjustment means provided for each of the printing units, the cylinder throwing-on timing adjustment means starting in response to the paper splicing signal and outputting a cylinder throwing-on signal after elapse of a preset period of time; and cylinder throwing-off/throwing-on means for simultaneously moving the blanket cylinders of the plurality of printing units from the printing position to the non-printing position in response to the paper splicing signal and for sequentially moving the blanket cylinders of the plurality of printing units from the non-printing position to the printing position in response to the cylinder throwing-on signal, from the furthest-upstream printing unit toward the furthest-downstream printing unit.

* * * * *